US005443002A

United States Patent [19]

Wolf

[11] Patent Number: 5,443,002

[45] Date of Patent: Aug. 22, 1995

[54] METHOD OF PRINTING ON FIBREGLASS

[76] Inventor: Kenneth Wolf, 892 Kilburn St., Kingston, Ontario, Canada, K7M 6A9

[21] Appl. No.: 90,619

[22] Filed: Jul. 12, 1993

[51] Int. Cl.[6] ..... B41C 1/06

[52] U.S. Cl. ..... 101/34; 156/277

[58] Field of Search ..... 101/34, 33, 492; 156/60, 307.1, 239, 240, 277

[56] References Cited

U.S. PATENT DOCUMENTS 4,746,560 5/1988 Gaeden ..... 428/151

*Primary Examiner*—Ren Yan

*Attorney, Agent, or Firm*—Dickinson, Wright, Moon, Van Dusen & Freeman

[57] ABSTRACT

A method of applying graphic images to a fibreglass surface. The graphic image is applied on an absorbent cellulose-based paper sheet. A coating of clear fibreglass resin is applied to the fibreglass surface and printed paper is then applied to the surface, before the resin has cured. A further coating of fibreglass resin is then applied on top of the paper, thus encasing it in resin.

7 Claims, 1 Drawing Sheet

METHOD OF PRINTING ON FIBREGLASS

BACKGROUND OF THE INVENTION

The present invention relates to a method for applying graphic images, such as symbols, words and the like, to the surfaces of items manufactured from fibreglass.

Currently there are several methods for applying graphic images to fibreglass surfaces: (1) vinyl self-adhesive decals (2) fibreglass cloth labels and (3) stencilling.

Vinyl decals do not adhere very well to fibreglass and usually have a 20% to 50% failure rate. Fibreglass cloth printing is very expensive. Stencilling allows for only very simple images and cannot be used for multi-colour requirements. Both decals and stencilling are particularly vulnerable to acids, solvents, chemicals and other compositions that would typically destroy a vinyl decal or a stencilled image.

It is an object of the present invention to provide an method of applying graphic images to fibreglass surfaces which avoids the problems or expense of such prior known methods.

SUMMARY OF THE INVENTION

According to the present invention there is provided a method of applying graphic images to a fibreglass surface. A graphic image to be applied is printed on an absorbent cellulose-based paper sheet. A coating of clear fibreglass resin is applied to the fibreglass surface. The printed paper is then applied to the surface, before the resin has cured. A further coating of fibreglass resin is then applied on top of the paper, thus encasing it in resin.

It is preferred that the cellulose-based paper sheet be cap tissue paper.

The method according to the present invention may be used in applying graphic images to a wide range of fibreglass products, such as the hulls of fibreglass boats, the sides of industrial fibreglass drums, etcetera. The method provides a totally sealed graphic image that becomes a part of the manufactured item. The only way that the image can be removed, once it is thus applied, is by sanding or grinding it off. As well, once applied, the image is immune from acids, solvents, chemicals or other items that would typically destroy a vinyl decal or a stencilled image.

The method of installation according to the present invention is very simple and uses materials (resins) with which persons manufacturing fibreglass products are already familiar. Once applied to a fibreglass product using a method according to the present invention, the graphic image appears as if to have been printed directly on that product.

BRIEF DESCRIPTION OF THE DRAWINGS

These and other objects and advantages of the invention will become apparent upon reading the following detailed description and upon referring to the drawings in which.

Figure 1:
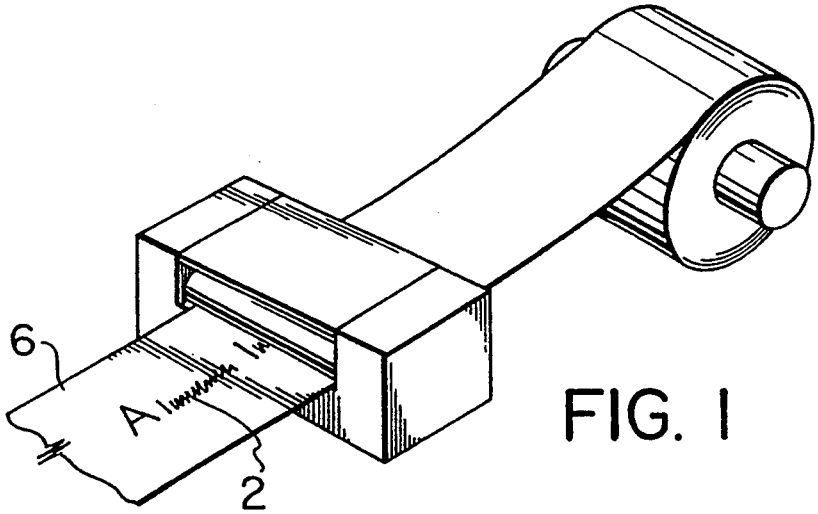
FIGS. 1, 2 and 3 are schematic sketches illustrating the steps of the method of the present invention.

While the invention will be described in conjunction with an example embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE INVENTION

In the drawings, similar features have been given similar reference numerals.

Turning to the drawings, as can be seen in FIG. 1, a graphic image 2 to be applied to a fibreglass surface 4 (FIG. 2) is printed on an absorbent cellulose-based paper sheet 6. The sheet 6 may be for example newsprint or tissue paper. It is preferred that it be cap tissue paper. It is important that the paper be absorbent to fibreglass resin.

Figure 2:
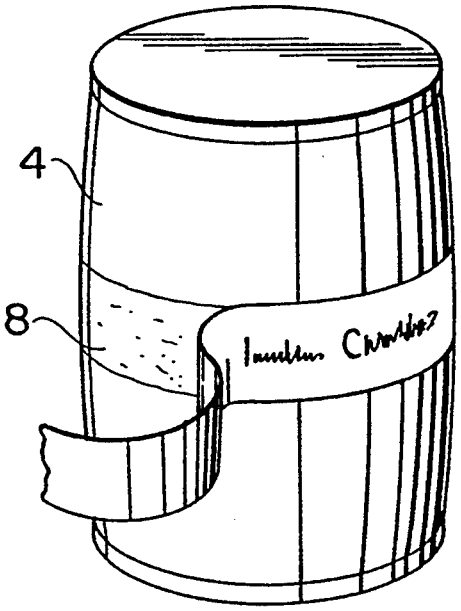
Figure 3:
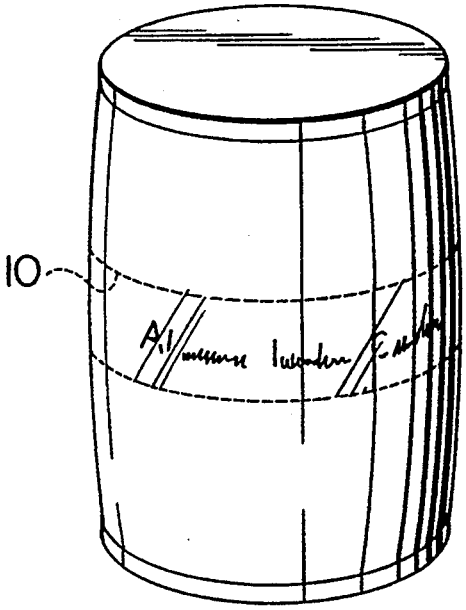

As can be seen in FIG. 2, a coating of clear fibreglass resin 8 is applied to a portion of the fibreglass surface 4 and paper sheet 6, on which image 2 has been printed, is then applied to that portion of the surface before the resin has cured. A further coating 10 of fibreglass resin is then applied on top of the paper, thus encasing it in resin.

The paper may be printed using any conventional printing process such as screen printing. In the case of newsprint, it may be printed on an offset or web offset press. Laser printing and photocopying may also be the means of printing.

Once applied to the surface of a fibreglass product, the paper with the graphic image printed thereon gives the appearance of the image having been printed directly on the fibreglass surface.

As previously indicated, the method according to the present invention is simple to carry out and effective in that it provides a totally sealed image.

Thus it is apparent that there has been provided in accordance with the invention a method of applying graphic images to fibreglass surfaces that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A method of applying graphic images to an existing, cured fibreglass surface comprising resin and fibreglass consisting essentially of the following steps:

(a) printing the graphic image to be applied on an absorbent, cellulose-based paper sheet;

(b) applying a coating of clear fibreglass resin to said existing surface;

(c) applying the printed paper to the resin coated surface before said coating of clear fibreglass resin is cured; and (d) applying a further coating of the fibreglass resin on top of the paper, thus encasing the paper in a resin envelope secured to said fibreglass surface.

2. A method according to claim 1 wherein the paper sheet is printed by screen printing.

3. A method according to claim 1 wherein the paper sheet is printed by laser printing.

4. A method according to claim 1, wherein the graphic image is printed on newsprint.

5. A method according to claim 1 wherein the graphic image is printed on tissue paper.

6. A method according to claim 1 wherein the paper sheet is printed by web offset printing.

7. A method according to claim 1 wherein the paper sheet is printed by photocopying.

* * * * *